US005896773A

United States Patent [19]

Lee

[11] Patent Number: 5,896,773

[45] Date of Patent: Apr. 27, 1999

[54] WINDOW/DOOR FRAME BAR PROCESSING PUNCH PRESS

[76] Inventor: Ming-Kun Lee, 2/F., No. 13, Hsing-Nan St., Nan-Kang Dist., Taipei City, Taiwan

[21] Appl. No.: 09/004,451

[22] Filed: Jan. 8, 1998

[51] Int. Cl.[6] ..... B21D 43/16

[52] U.S. Cl. ..... 72/428; 72/333; 72/460; 72/470

[58] Field of Search ..... 72/333, 335, 428, 72/456, 460, 470, 476, 477; 83/462

[56] References Cited

U.S. PATENT DOCUMENTS

| | | | |
|---|---|---|---|
| 1,337,474 | 4/1920 | Jennings | 72/476 |
| 1,361,311 | 12/1920 | De La Pena | 72/477 |
| 3,675,462 | 7/1972 | Ponce | 72/428 |
| 3,949,589 | 4/1976 | Johnson et al. | 72/456 |
| 5,365,767 | 11/1994 | Kitchen et al. | 72/456 |
| 5,732,591 | 3/1998 | Johnson | 72/476 |

*Primary Examiner*—Joseph J. Hail, III
*Assistant Examiner*—Ed Tolan
*Attorney, Agent, or Firm*—Rosenberg, Klein & Bilker

[57] ABSTRACT

A frame bar processing punch press having a bottom die holder holding a bottom die, and an upper die holder holding an upper die, the upper die holder being driven by a reciprocating rod to strike the upper die against the workpiece carried on the bottom die, the bottom die holder having a horizontal top plate which holds the bottom die, a horizontal bottom plate, and a flat vertical board on the middle between the horizontal top plate and the horizontal bottom plate, the flat vertical board having at least one vertical sharp edge at one side for guiding the workpiece into processing position.

1 Claim, 6 Drawing Sheets

WINDOW/DOOR FRAME BAR PROCESSING PUNCH PRESS

BACKGROUND OF THE INVENTION

The present invention relates to a punch press, and more particularly to a window frame bar processing punch press specifically designed for processing window or door frame bars.

A frame bar for a window or door may have to be processed at the job site to provide an opening and mounting tabs in the opening for mounting a strike plate for a lock. However, it is complicated to make an opening on a window or door frame bar and mounting tabs in the opening manually at the job site. Furthermore, the quality of the mounting tabs is poor because it is manually processed.

SUMMARY OF THE INVENTION

The present invention has been accomplished to provide a frame bar processing punch press which is specifically designed for processing window and door frame bars. According to the invention, the frame bar processing punch press comprises a bottom die holder holding a bottom die, and an upper die holder holding an upper die, the upper die holder being driven by a reciprocating rod to strike the upper die against the workpiece carried on the bottom die, wherein the bottom die holder has a substantially I-shaped profile, and a flat vertical board on the middle, the flat vertical board having at least one vertical sharp edge at one side for guiding the workpiece into processing position.

DETAILED DESCRIPTION OF THE PREFERRED EMBODIMENT

Figure 1:
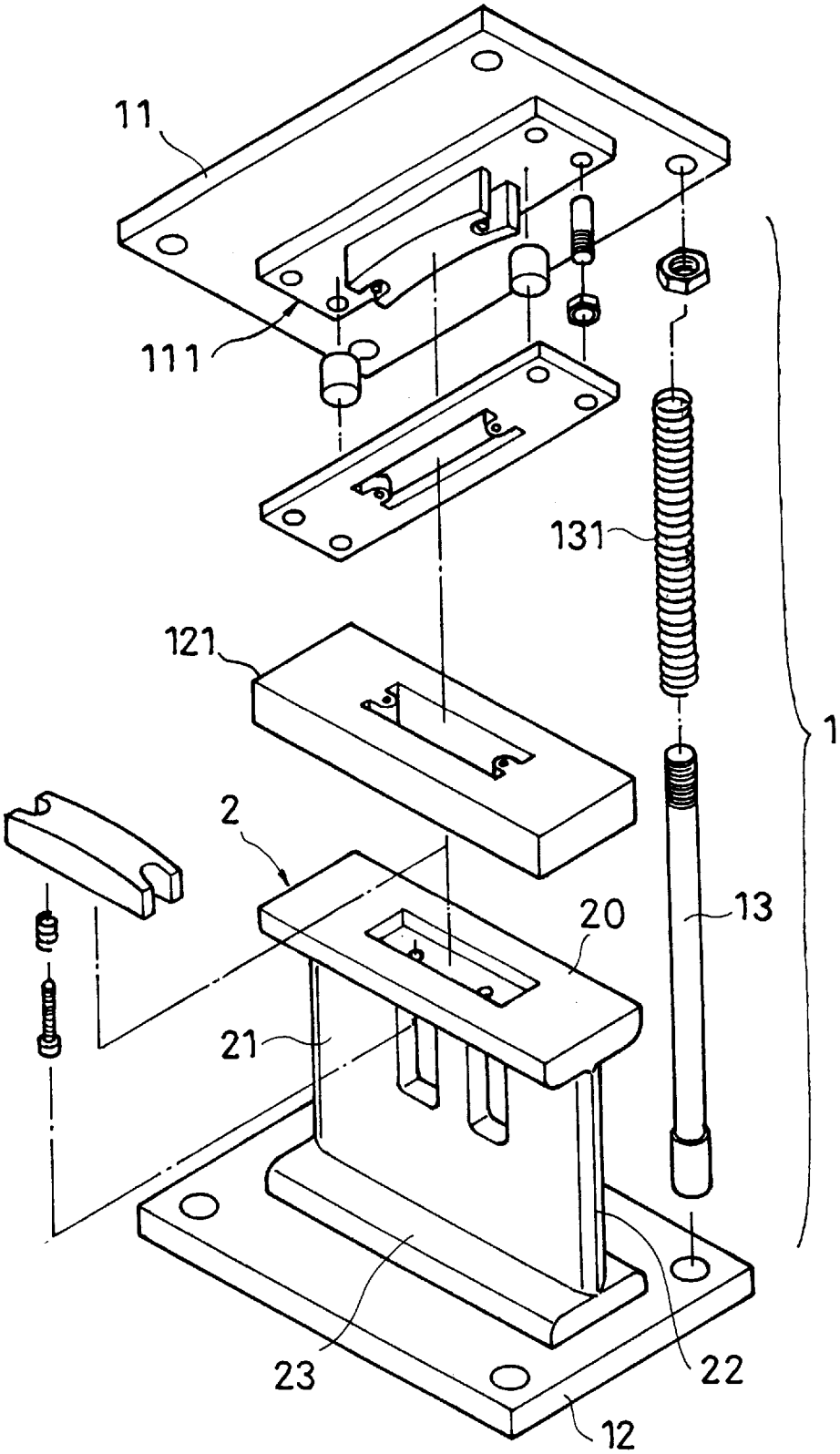
FIG. 1 is an exploded view of a punching die assembly for a window/door frame bar processing punch press according to the present invention.
Figure 2:
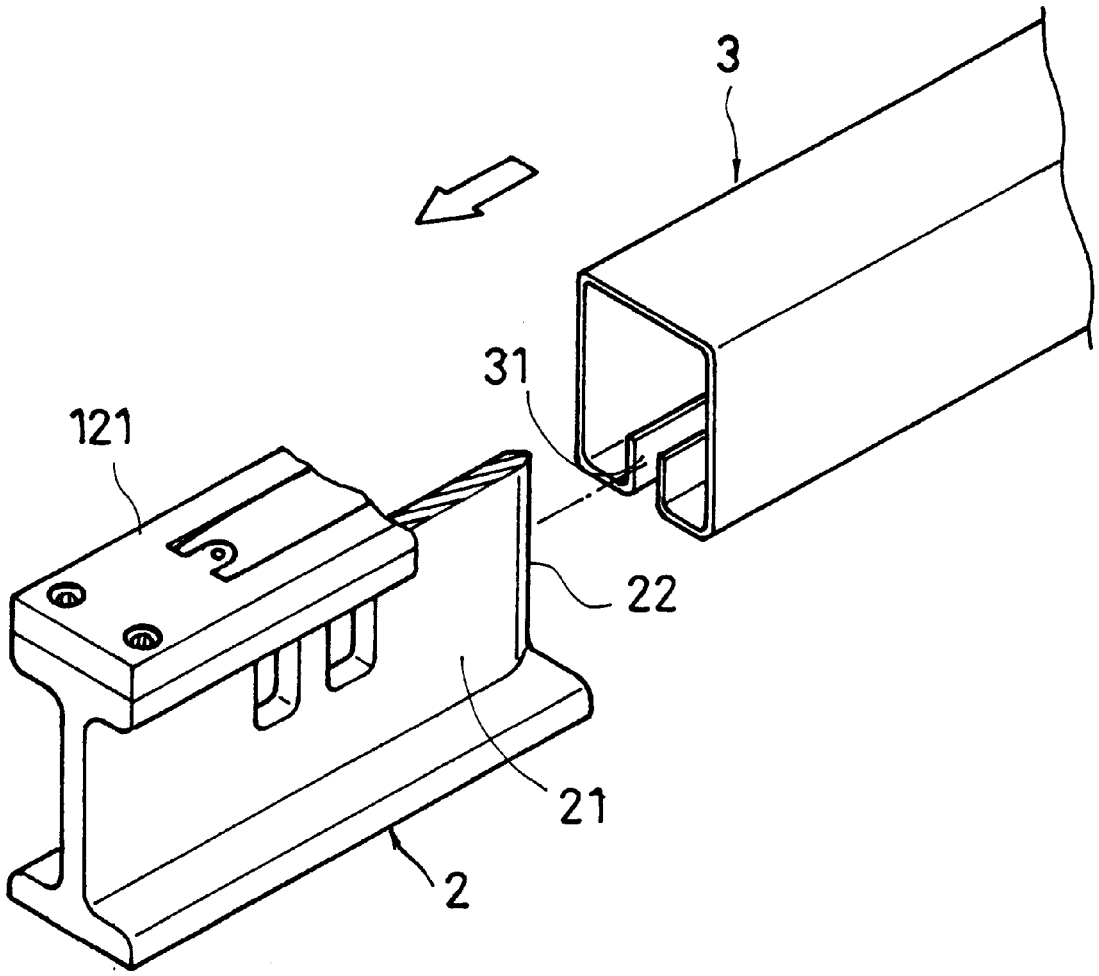
FIG. 2 is a cutaway view of the bottom die holder and the bottom die, showing the loading direction of the frame bar to be processed.
Figure 3:
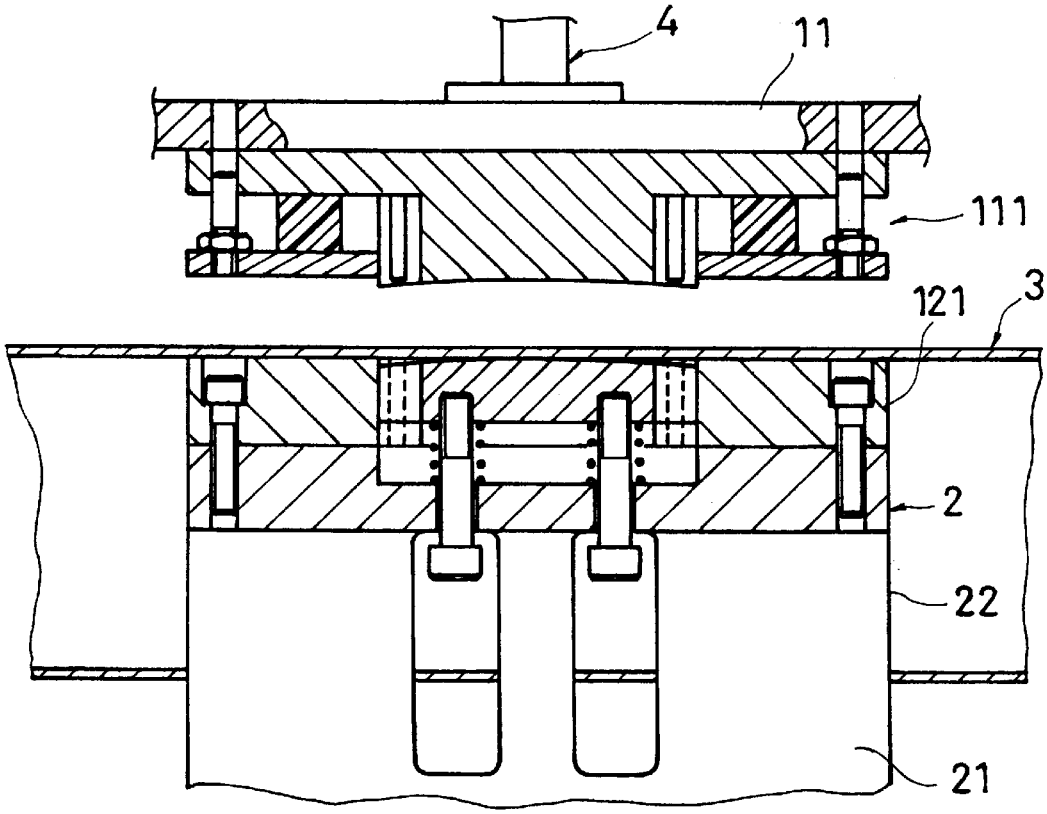
FIG. 3 is a sectional view of the present invention, showing the frame bar to be processed mounted on the bottom die.
Figure 4:
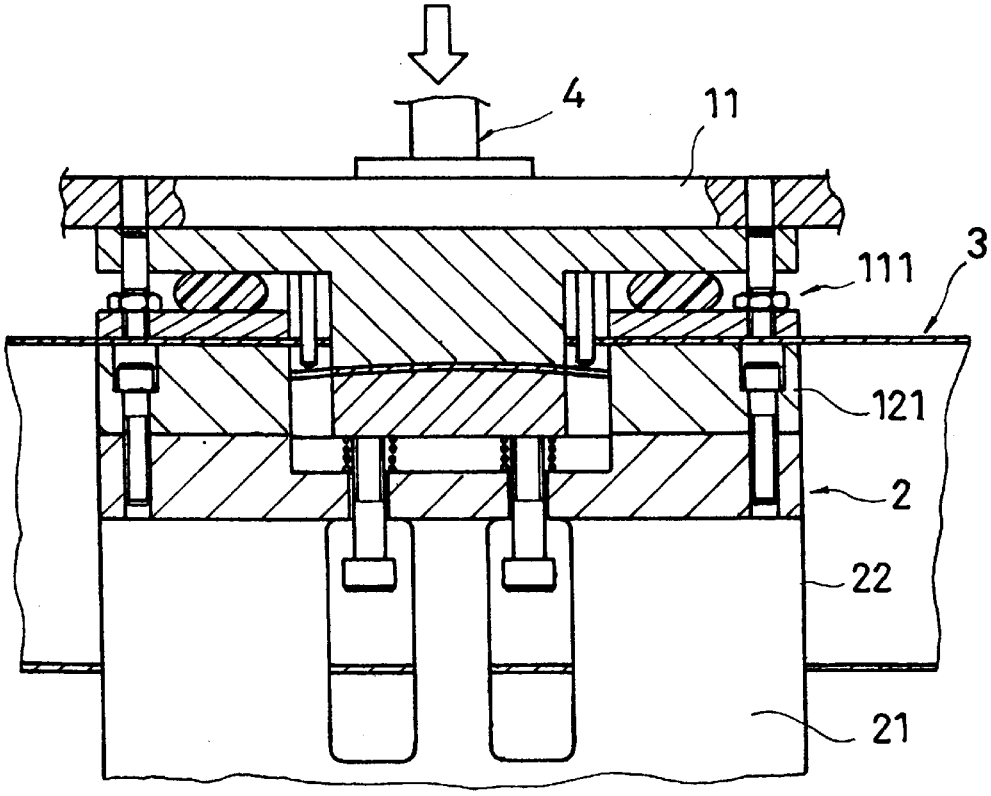
FIG. 4 is similar to FIG. 3 but showing the upper die pressed on the frame bar against the bottom die.
Figure 9:
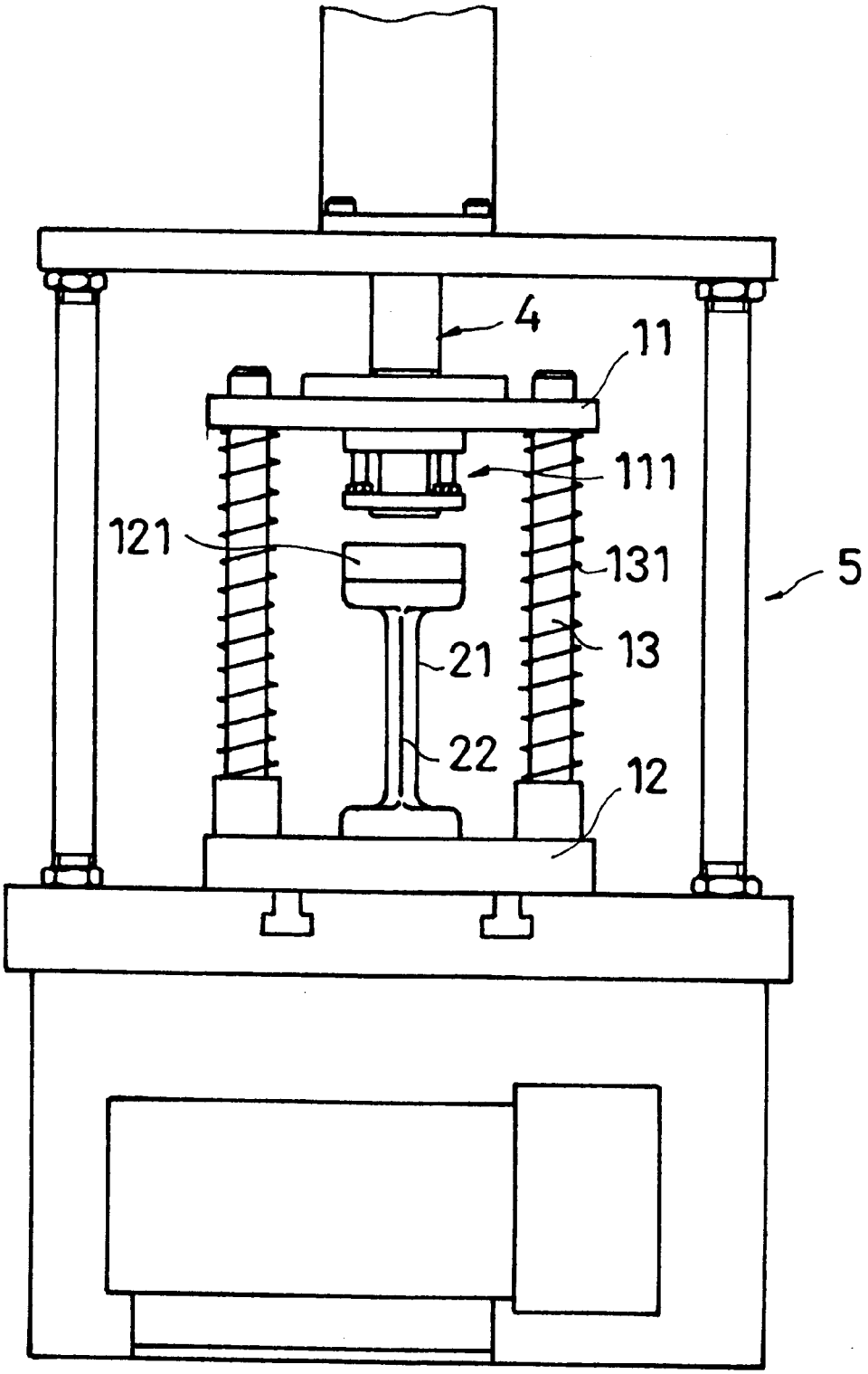
FIG. 9 is side plain view of the window/door frame bar processing punch press according to the present invention.

Referring to FIGS. 1, 2 and 9, a window/door frame bar processing punch press 5 in accordance with the present invention comprises a punching die assembly which is comprised of a flat upper die holder 11, an upper die 111, a bottom die 121, a bottom die holder 2, a base plate 12, a plurality of guide rods 13, and a plurality of springs 131. The upper die 111 is fixedly fastened to the flat upper die holder 11 at the bottom. The bottom die 121 is fixedly fastened to the bottom die holder 2 at the top. The bottom die holder 2 is mounted on the base plate 12. The guide rods 13 are respectively mounted in four corners of the base plate 12 in vertical. The springs 131 are respectively mounted around the guide rods 13. The top press plate is supported on the springs 131, and moved along the guide rods 13. The springs 131 impart an upward pressure to the flat upper die holder 11. The bottom die holder 2 is a substantially I-shaped frame, having a horizontal top plate 20 which holds the bottom die 121, a horizontal bottom plate 23 which is fastened to the base plate 12, and a flat vertical board 21 connected between the horizontal top plate 20 and the horizontal bottom plate 23. The flat vertical board 21 of the bottom die holder 2 has a sharp edge 22 at one side. When mounting a window (door) frame bar 3 on the bottom die 121 for processing, the longitudinal slot 31 of the window (door) frame bar 3 is aimed at the sharp edge 22 of the flat middle board 21, and therefore the window (door) frame bar 3 can be horizontally mounted onto the bottom die 121 and the bottom die holder 2.

Figure 5:
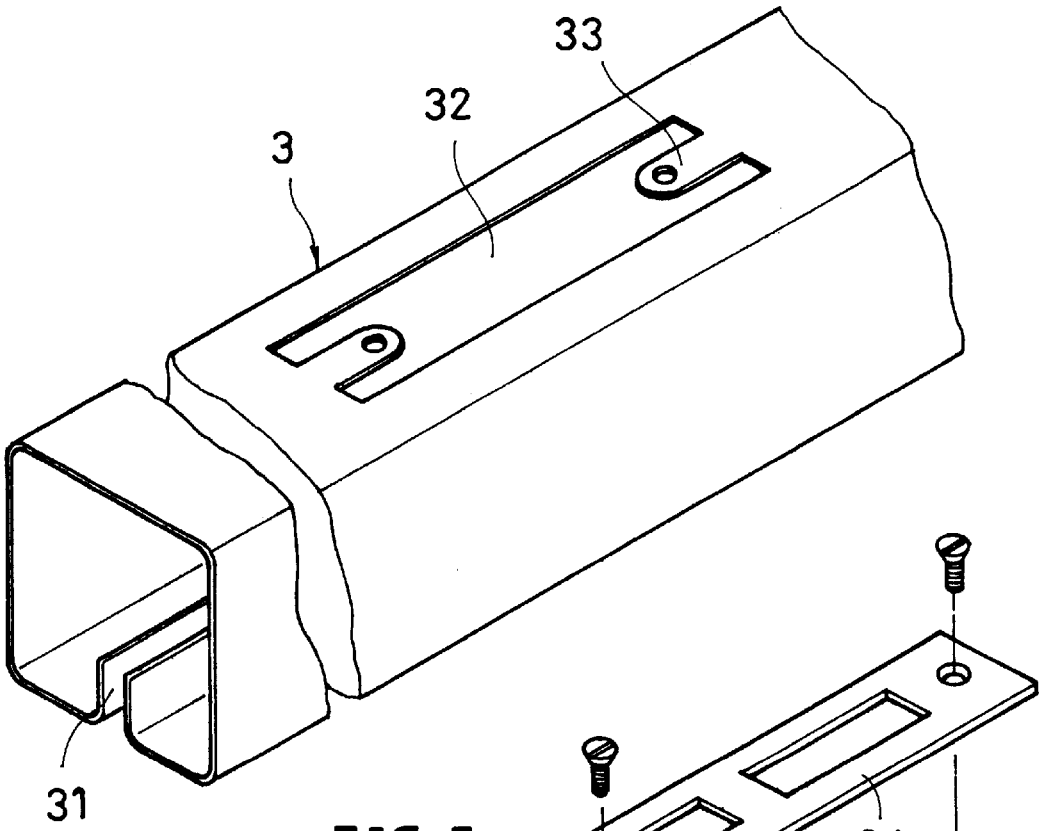
FIG. 5 shows a frame bar processed according to the present invention.
Figure 8:
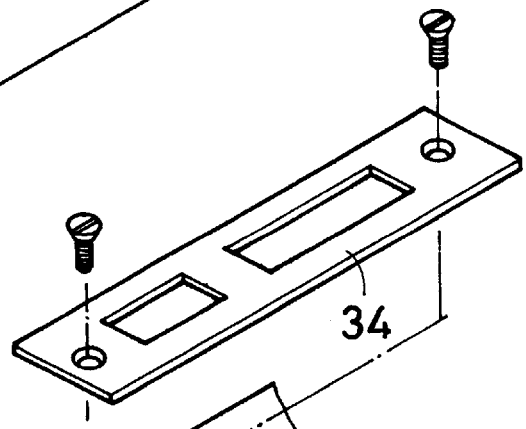
FIG. 8 shows the mounting of a strike plate on the secondarily processed frame bar.
Figure 8:
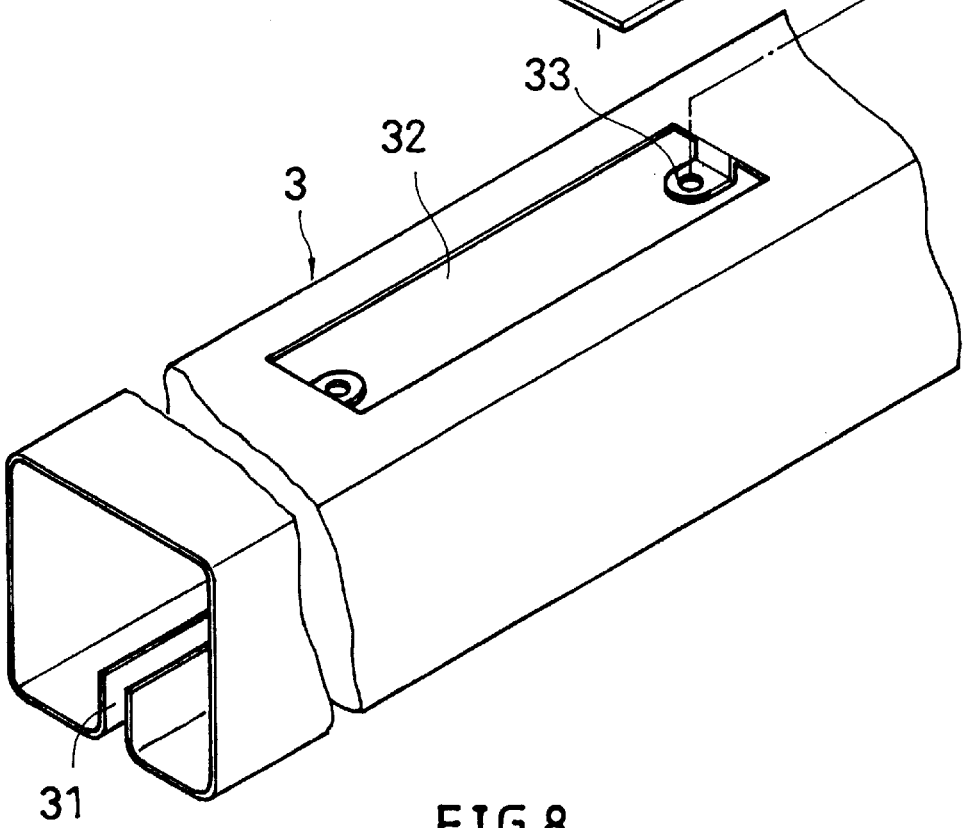
Figure 6:
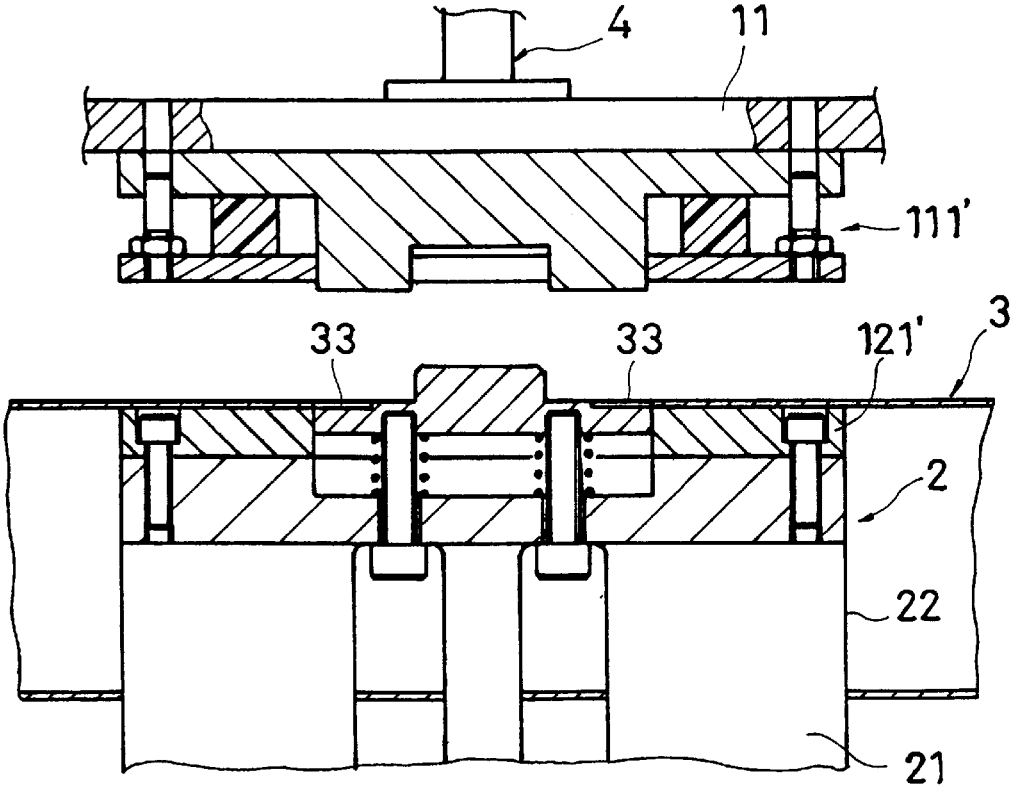
FIG. 6 shows the processed frame bar loaded on the bottom die of a second punch press for a secondary processing.
Figure 7:
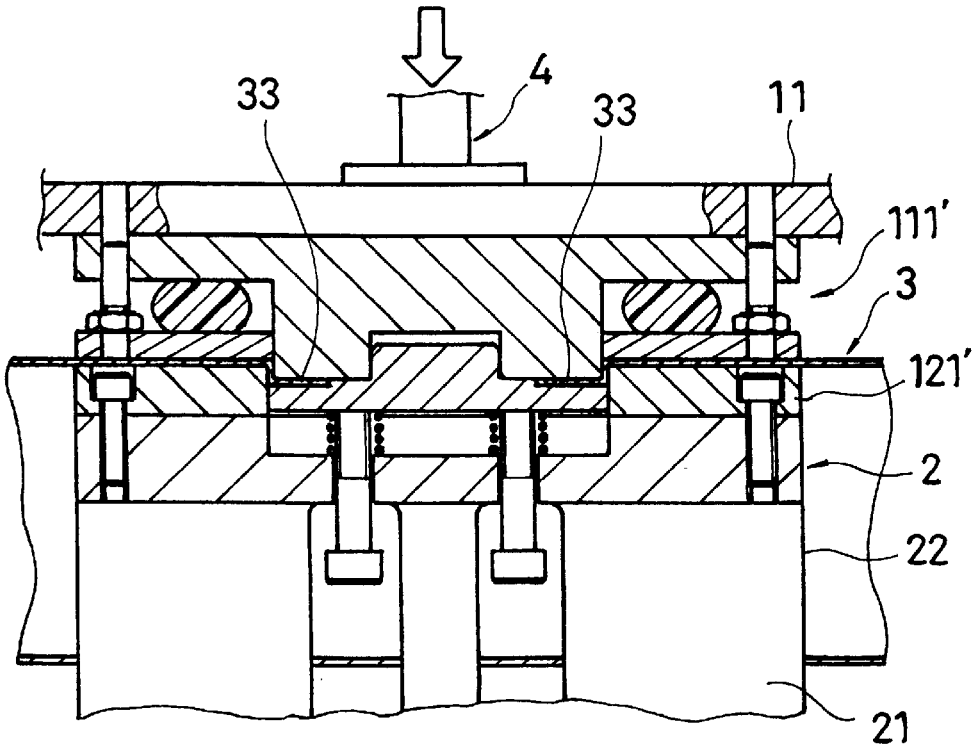
FIG. 7 is similar to FIG. 6 but showing the upper die pressed on the processed frame bar against the bottom die.

Referring to FIGS. from 3 to 8, when the window (door) frame bar 3 is horizontally inserted into the space between the upper die 111 and the bottom die 121 and then supported on the bottom die 121, the reciprocating rod 4 which is connected to the flat upper die holder 11 is extended out to lower the upper die holder 11 in a rush, thereby causing the upper die 121 to strike the window (door) frame bar 3 against the bottom die 121. After punching, an opening 32 is provided at the window (door) frame bar 3, and two mounting tabs 33 are provided within the opening 32 at two opposite sides in flush with the window (door) frame bar 3 (see FIG. 5). The processed window (door) frame bar 3 is then mounted in between the upper die 111' and bottom die 121' of another press (see FIGS. 6 and 7), permitting the mounting tabs 33 to be stamped into an angled shape suspended from the opening 32, so that a strike plate 34 can be fixedly fastened to the mounting tabs 33 in the opening 32 in flush with the window (door) frame bar 3 (see FIG. 8).

While only one embodiment of the present invention has been shown and described, it will be understood that various modifications and changes could be made thereunto without departing from the spirit and scope of the invention disclosed.

What the invention claimed is:

1. A punch press for processing tubular frame members having a longitudinally directed slot formed through one wall thereof, said punch press comprising a base plate, a bottom die holder mounted on said base plate, a bottom die mounted on said bottom die holder, a plurality of vertical guide rods mounted on said base plate and spaced around said bottom die holder, an upper die holder movable along said vertical guide rods relative to said bottom die, an upper die fixedly fastened to said upper die holder at a bottom side and movable with said upper die holder relative to said bottom die, a plurality of springs respectively mounted on said vertical guide rods and imparting an upward pressure to said upper die holder, a reciprocating rod connected to said upper die holder and controlled to force said upper die holder and said upper die downwards toward said bottom die, wherein said bottom die holder has a horizontal top plate which holds said bottom die, a horizontal bottom plate which is fastened to said base plate, and a flat vertical board connected between said horizontal top plate and said horizontal bottom plate, said flat vertical board having at least one vertically directed sharp edge at one side for interface with the longitudinal slot of the tubular frame to direct said vertical board into the longitudinal slot as the tubular frame member is displaced relative to said vertical board toward said bottom die.

* * * * *